252-103 AU 166 EX
7/12/83 XR 4,392,975

United States Patent [19]
Tourdot et al.

[11] 4,392,975
[45] Jul. 12, 1983

[54] ACTIVATING COMPOSITION FOR BLEACHING WITH PEROXIDE PRODUCTS

[75] Inventors: Jacques Tourdot, Paris; Henry Carron, Pantin, both of France

[73] Assignee: L'Air Liquide Societe Anonyme pour l'Etude et l'Exploitation des Procedes, Paris, France

[21] Appl. No.: 304,586

[22] Filed: Sep. 22, 1981

[30] Foreign Application Priority Data

Apr. 9, 1981 [FR] France ..... 81 07107

[51] Int. Cl.[3] ..... C11D 7/18; C11D 7/36
[52] U.S. Cl. ..... 252/99; 252/95; 252/102; 252/103; 252/174.16; 252/174.18
[58] Field of Search ..... 252/95, 99, 102, 103, 252/174.16, 174.18

[56] References Cited

U.S. PATENT DOCUMENTS 3,740,187 6/1973 Kowalski .
3,766,078 10/1973 Kowalski .
3,795,625 3/1974 Kowalski .
3,951,840 4/1976 Fujino et al. ..... 252/102
4,025,453 5/1977 Kravetz et al. .
4,086,175 4/1978 Kravetz et al. ..... 252/99
4,119,557 10/1978 Postlethwaite ..... 252/99
4,179,390 12/1979 Spadini et al. ..... 252/95
4,259,200 3/1981 Sims et al. ..... 252/102
4,279,769 7/1981 Yagi et al. .

FOREIGN PATENT DOCUMENTS 2140213 1/1973 France .
2420593 10/1979 France .

*Primary Examiner*—John E. Kittle
*Assistant Examiner*—Robert Wax
*Attorney, Agent, or Firm*—Browdy & Neimark

[57] ABSTRACT

An activating composition for bleaching textiles with peroxide products, containing an activator of the cyanamide type or derivative thereof, further contains a ternary protective mixture comprising a magnesium silicate precipitated in the finely divided powder state, a sequestering agent of the acetic type, preferably organoacetic, and a sequestering agent of the phosphonic type, preferably organophosphonic. The composition finds its application in activation of bleaching at moderate temperature with protection of textile fibers, of household washing powders at moderate temperature (30° to 60° C.) or any temperature (up to 90° C.).

20 Claims, No Drawings

ACTIVATING COMPOSITION FOR BLEACHING WITH PEROXIDE PRODUCTS

FIELD OF THE INVENTION

This invention relates to an activating composition for bleaching at moderate temperature, particularly intended for detergents and detersives containing, as the bleaching agent, peroxide products able to release active oxygen.

BACKGROUND OF THE INVENTION

Liquid bleaching agents generating active oxygen such as hydrogen peroxide or solid bleaching agents such as persalts such as sodium perborate, decompose at a fast enough rate to be compatible with a bleaching process only at temperatures above 60° C.

Household washing powders at moderate temperature are a currect topic linked to the problem of energy savings. Further, use in a washing machine of an effective bleaching process at a temperature below 60° C. offers certain advantages. In the case of cotton fabrics less degradation of the cellulose is noted and consequently there is a reduction in the wear of clothes. An improved bleaching is observed in synthetic fabrics or textile articles treated with a sizing agent assuring their crease resistance and permanent pressing and which cannot support a temperature above 60° C. Bleaching at moderate temperature reduces the risk of attack of the dyes or their transfer from one fabric to the other. This type of bleaching also promotes the fight against pollution by lowering the polyphosphate content of the waste waters.

There is known from U.S. Pat. No. 4,025,453 a process of activating a peroxide base bleaching agent in which have been incorporated in an aqueous medium: (a) a peroxide base bleaching agent, (b) cyanamide and/or a metallic cyanamide in an amount suitable for activating the peroxide, and, optionally (c) a Group II A metal compound. The aqueous medium is kept in an alkaline state, optionally by incorporating a buffer therein, provided that if constituent (b) is cyanamide and if constituent (c) is absent, the aqueous medium is kept at a pH greater than 7.5.

However, it has been found that bleaching in the presence of a cyanamide type activator causes a certain depolymerization of textile polymers and particularly cellulose fibers.

The degradation observed is particularly pronounced when the washing temperature exceeds 60° C., and especially when it reaches 90° C.; a 90° C. temperature is a relatively frequent case when an all-temperature washing powder is involved. At 90° C., depolymerization is such that it causes a degradation that can hasten the wear of cotton clothing during successive washings.

On the other hand, although the prior teaching has proposed ethylenediaminetetraaceticdimagnesium compound as constituent (c) of the activating composition, it has been observed that this adjuvant, under prescribed use conditions, has practically no effect on the degradation observed in cellulose fibers.

SUMMARY OF THE INVENTION

A protective composition has been sought that makes it possible to reduce the aggressiveness of cyanamide toward cellulose fibers while retaining its performance of activating peroxide compounds.

A protective composition has been found that considerably reduces the effect of degradation of cellulose fibers by cyanamide and its derivatives, while in no way limiting the bleaching effectiveness obtained by activation of the peroxide compounds by cyanamide and its derivatives.

This protective composition has no unfavorable impact on the bleaching results and makes it possible to reduce the aggressiveness of the cyanamide to the level of that of tetraacetylethylenediamine (TAED). With the new composition, it was found possible to obtain equivalent results of bleaching and degree of polymerization with calcium cyanamide CaNCN at 0.2 g/liter as can be obtained with TAED at 0.6 g/liter.

Since calcium cyanamide is an activator about three times as active as tetraacetylethylenediamine (TAED) and, on the other hand, cyanamide is less expensive than TAED, the economic advantage of the present activating composition can be seen.

The activating composition for bleaching in accordance with the present invention contains an activator of the cyanamide type or its derivatives, alone or in mixture, to activate bleaching with peroxide products at moderate temperature; it further contains a ternary protective mixture, with synergistic effect, comprising a magnesium silicate in finely divided powdered state, a sequestering agent of the acetic type, preferably organoacetic, and a sequestering agent of the phosphonic type, preferably organophosphonic.

DETAILED DESCRIPTION OF PREFERRED EMBODIMENTS

It has been found that the ternary protective mixture procures the most effective protection although the concentration of each constituent is less than either each constituent used alone or binary mixtures of them; as a consequence, the association of the three components has a clearly marked synergistic effect.

The acetic sequestering agents may be nitrilotriacetic acid, hexamethylenediaminetetraacetic acid, ethylene diaminetetraacetic acid and, preferably, diethylenetriaminepentaacetic acid.

The phosphonic sequestering agents may be nitrilomethylenephosphonic acid, ethylenediaminetetramethylenephosphonic acid, and, preferably, diethylene triaminopentamethylenephosphonic acid.

The acetic and phosphonic sequestering agents are selected in the form of free acid or salts of alkali or alkaline earth metals.

Very advantageous results are obtained by using the activating composition made up of calcium cyanamide and/or its derivatives and the protective mixture comprising magnesium silicate precipated in the finely divided powder state and, in magnesium complex form, diethylenetriaminepentaacetic acid and diethylenetriaminepentamethylenephosphonic acid.

The cyanamide derivatives may be alkali metal or alkaline earth metal cyanamide, preferably, calcium cyanamide, magnesium cyanamide or sodium cyanamide.

The activating composition is intended to be incorporated in washing powders, particularly household washing powders for washing and bleaching clothes at moderate temperature.

On the other hand, it is important for the effectiveness of the activating composition that it be dispersed as powder homogeneously in the washing powder and in a form that permits its homogeneous distribution in the wash bath. For example, for only slightly soluble cyanamide compounds, particularly calcium cyanamide, it is advantageous to use a powder less than 100 microns.

The finely divided calcium cyanamide powder is homogenized with a standard powder mixer, in the precipitated magnesium silicate already containing the acetic sequestering agent and the phosphonic sequestering agent.

The phosphonic sequestering agent and acetic sequestering agent are incorporated in the magnesium silicate, preferably during the process of making the magnesium silicate; they can also be incorporated after it has been made.

The activating composition comprises a protective mixture with a precipitated magnesium silicate base in which are incorporated, in magnesium complex form, 3 to 30%, preferably 5 to 15%, of an acetic type sequestering agent and 5 to 50%, preferably 8 to 25%, of a phosphonic type sequestering agent, the portions being indicated by weight in relation to the magnesium silicate.

It has been found advantageous that the activating composition contain from 20 to 150%, preferably 30 to 100%, by weight, of activator of the cyanamide type and its derivatives in relation to the protective mixture representing 100%.

Very good results have been obtained by using the activating composition in a concentration in the washing powder bath between 0.2 and 1 gram per liter, preferably, between 0.4 and 0.8 gram per liter.

The following nonlimiting examples illustrate the results and advantages of the invention.

Definitions and characteristics of the products used in the various tests:

CaNCN: white calcium cyanamide with 96% purity, granulometry less than 100 microns;

$MgSiO_3$: precipitated magnesium silicate having a specific surface of about 250 $m^2/g$;

TAED: tetraacetylethylene diamine;

Product sold by the tradename "Dequest 2060": diethylenetriaminepentamethylenephosphonic acid;

Product sold by the tradename "Versenex 80": sodium salt of diethylenetriaminepentaacetic acid, in 40% solution of active product;

Product sold by the tradename "Versene 100": sodium salt of ethylenediaminetetraacetic acid in 40% solution of active product;

EDTA (Mg): ethylenediaminetetraacetic acid at 70% active product;

EXAMPLE 1

Bleaching test without protective composition.

A washing powder bath was prepared from city water to which was added an ECE washing powder, sodium perborate and an activator. The ECE washing powder had the following composition in percentage by weight:

Linear sodium alkyl benzene sulfonate: 8.0
Ethoxylated tallow alcohol: 2.9
Sodium soap: 3.5
Sodium tripolyphosphate: 43.8
Sodium silicate: 7.5
Magnesium silicate: 1.9
Carboxymethylcellulose: 1.2
Sodium ethylenediaminetetraacetate: 0.2
Sodium sulfate: 21.2
Water: 9.8

A Terg-O-Tometer apparatus containing 1 liter of washing bath was used, in which were placed:

2 samples, 10×10 cm, soiled with wine;
2 samples, 10×10 cm, soiled with tea;
2 samples, 10×10 cm, soiled with coffee.

The samples for studying the degradation of the cellulose were taken from a cotton fabric, reference EMPA 301 used in the textile and bleaching industry supplied by the Federal Materials Testing Laboratory of the St. Gall Research Institute in Switzerland, whose initial degree of polymerization (DP) was 2,000.

Six washing tests were made in a 40-minute period, including raising of temperature, agitation being regulated at 60 rpm. The washing conditions and results are given in table 1 below; the degree of polymerization was determined after five successive washings at 90° C.

TABLE 1

| | | | | Bleaching at 30° C. | | | Bleaching at 60° C. | | | |
|---|---|---|---|---|---|---|---|---|---|---|
| TEST N° | WASHING POWDER ECE g/l | Na Perborate g/l | Activator g/l | Final pH | % Residual AO | % Removal Spots | Final pH | % Residual AO | % Removal Spots | DP 90° C. |
| 1 | 9 | 0 | 0 | 9.6 | | 15 | 9.6 | | 17 | 2,000 |
| 2 | 9 | 1.5 | 0 | 9.7 | 100 | 40 | 9.7 | 100 | 62 | 1,990 |
| 3 | 9 | 1.5 | TAED 0.3 | 9.5 | 80 | 54 | 9.3 | 67 | 73 | 1,930 |
| 4 | 9 | 1.5 | TAED 0.6 | 9.3 | 50 | 59 | 9.2 | 28 | 75 | 1,900 |
| 5 | 9 | 1.5 | CaNCN 0.2 | 10.1 | 74 | 58 | 10.0 | 58 | 78 | 1,600 |
| 6 | 9 | 1.5 | CaNCN 0.3 | 10.3 | 57 | 61 | 10.1 | 34 | 79 | 1,400 |

From reading this table, it appears that after a succession of five washings at 90° C. with ECE washing powder only, no reduction of the degree of polymerization of the fabric was observed. After the same succession of washings in the presence of 1.5 g of sodium perborate, depolymerization is practically nonexistent. On the other hand, it is noted that TAED tetraacetylethylene diamine has the effect of very slight depolymerization. On the contrary, calcium cyanamide (CaNCN) has a very marked effect, since the degree of polymerization is no more than 1400 when the CaNCN concentration is 0.3 g/l. Further, it is noted that calcium cyanamide at 0.2 g/l gives a percentage of spot removal nearly equivalent to that of TAED at 0.6 g/l; this would seem to mean, in a first approximation, that calcium cyanamide has an activation power at 30° to 60° C. about three times greater than that of TAED.

EXAMPLE 2

A series of 13 bleaching tests were made with protective products or compositions under the same conditions as test 6 of table 1, i.e., with 0.3 g/l of cyanamide.

The results of these thirteen tests are given in table 2 below; the degree of polymerization of cotton was determined after five successive washings to 90° C.

TABLE 2

| TEST N° | PROTECTOR | g/l | D.P. |
|---|---|---|---|
| 6 | None | 0 | 1,400 |
| 7 | Mg $SiO_3$ | 0.30 | 1,530 |
| 8 | "VERSENEX 80" | 0.06 | 1,520 |
| 9 | EDTA (Mg) | 0.06 | 1,450 |
| 10 | EDTA (Mg) | 0.09 | 1,480 |
| 11 | "VERSENE 100" | 0.06 | 1,480 |
| 12 | "VERSENE 100" | 0.09 | 1,520 |
| 13 | "DEQUEST 2060" | 0.06 | 1,670 |
| 14 | "DEQUEST 2060" | 0.09 | 1,700 |
| 15 | Mg $SiO_3$ | 0.30 | 1,600 |
| | "VERSENEX 80" | 0.06 | |
| 16 | Mg $SiO_3$ | 0.30 | 1,700 |
| | "DEQUEST 2060" | 0.06 | |
| 17 | "DEQUEST 2060" | 0.06 | 1,740 |
| | "VERSENEX 80" | 0.06 | |
| 18 | Mg $SiO_3$ | 0.25 | 1,760 |
| | "VERSENEX 80" | 0.02 | |
| | "DEQUEST 2060" | 0.03 | |

The compared results of this table show that magnesium silicate exerts a notable protective effect, almost equivalent to that of sodium salt of diethylenetriaminepentaacetic acid ("Versenex 80") and of sodium salt of ethylenediaminetetraacetic acid ("Versene 100") at 0.09 g/l. The mixture of magnesium silicate+sodium salt of diethylenetriaminepentaacetic acid (test 15) has a less marked effect; however, the protective effect of diethylenetriaminepentamethylenephosphonic acid ("Dequest 2060") is still greater than that of the mixture of $MgSiO_3$+"Versenex 80" of test 15; and the protective effect of the mixture of magnesium silicate+diethylenetriaminepentamethylenephosphonic acid ("Dequest 2060") is clearly reinforced.

Finally, it has been found that the ternary mixture of magnesium silicate+sodium salt of diethylenetriaminepentaacetic acid+diethylenetriaminepentamethylenephosphonic acid procures the most effective protection although the concentration of each constituent is less either than each constituent used alone or binary mixtures. Consequently, it appears that the association of three components has a clearly marked synergistic effect.

EXAMPLE 3

Nine bleaching tests were made with protective agents or protective compositions under conditions identical with those of test No. 5 of table 1 with 0.2 g/l of calcium cyanamide.

The results of these tests are given in the table below, the degree of polyermization was determined after five successive washings at 90° C.

TABLE 3

| TEST N° | PROTECTOR | g/l | D.P. |
|---|---|---|---|
| 5 | none | 0 | 1,600 |
| 19 | Mg $SiO_3$ | 0.30 | 1,700 |
| 20 | "DEQUEST 2060" | 0.04 | 1,730 |
| 21 | "DEQUEST 2060" | 0.08 | 1,780 |
| 22 | "DEQUEST 2060" | 0.12 | 1,800 |
| 23 | "VERSENE 100" | 0.08 | 1,650 |
| 24 | EDTA (mg) | 0.05 | 1,660 |
| 25 | Mg $SiO_3$ | 0.4 | 1,760 |
| | "VERSENEX 80" | 0.04 | |
| 26 | Mg $SiO_3$ | 0.4 | 1,840 |
| | "DEQUEST 2060" | 0.04 | |
| | Mg $SiO_3$ | 0.30 | |

TABLE 3-continued

| TEST N° | PROTECTOR | g/l | D.P. |
|---|---|---|---|
| 27 | "VERSENEX 80" | 0.03 | 1,900 |
| | "DEQUEST 2060" | 0.04 | |

It can be seen that magnesium silicate exerts a protective effect greater than that of sodium salt of ethylenediaminetetraacetic acid ("Versene 100") and of magnesium salt of ethylenediaminetetraacetic acid. On the other hand, diethylenetriaminepentamethylenephosphonic acid ("Dequest 2060") has a protective action slightly more than that of magnesium silicate when it is used at 0.04 g/l. The protective effect of the binary mixture of magnesium silicate+sodium salt of diethylenetriaminepentaacetic acid ("Versenex 80") is slightly more than that of magnesium silicate alone (test 25). Test 26 shows that the protective power of magnesium silicate is clearly reinforced by addition of diethylenetriaminepentamethylenephosphonic acid.

However, test 27 again shows that the ternary mixture of magnesium silicate+diethylenetriaminepentaacetic (Na) acid+diethylenetriaminepentamethylenephosphonic acid had the best protective effect although each component is used in a concentration equal to or less than that of the tests in which it is used alone or in binary mixture. On the other hand, it is noted that the degree of polymerization of cotton treated in the presence of the ternary mixture (1900) is identical with that in test 4 of table 1 with 0.6 g/l of tetraacetylethylenediamine (TAED).

This shows that with the ternary composition at synergistic effect, it is possible to obtain equivalent results of bleaching and degree of polymerization between TAED at 0.6 g/l and cyanamide at 0.2 g/l.

It will be obvious to those skilled in the art that various changes may be made without departing from the scope of the invention and the invention is not to be considered limited to what is described in the specification.

What is claimed is:

1. In an activating composition for bleaching fibers with peroxide products, containing an activator of the cyanamide type or a derivative thereof, the improvement wherein the composition further contains a ternary protective mixture for protecting the fibers against the injurious effect of the cyanamide compound or derivative, said protective mixture comprising a finely divided magnesium silicate powder, a sequestering agent of the acetic type and a sequestering agent of the phosphonic type.

2. An activating composition for bleaching in accordance with claim 1 wherein said acetic sequestering agent is of the organoacetic type and the phosphonic sequestering agent is of the organophosphonic type.

3. An activating composition for bleaching in accordance with claim 1 wherein the acetic sequestering agent is nitrilotriacetic acid, hexamethylenediaminetetraacetic acid, ethylenediaminetetraacetic acid, or diethylenetriaminepentaacetic acid, in the form of free acid or of an alkali metal or alkaline earth metal salt, and said phosphonic sequestering agent is nitrilotrimethylenephosphonic acid, ethylenediaminetetramethylenephosphonic acid or diethylenetriaminopentamethylenephosphonic acid in the form of free acid or of an alkali metal or alkaline earth metal salt.

4. An activating composition for bleaching in accordance with claim 1 wherein said acetic sequestering agent is diethylenetriaminepentaacetic acid in the form of free acid or an alkali metal or alkaline earth metal salt, and said phosphonic sequestering agent is diethylenetriaminopentamethylenephosphonic acid in form of free acid or an alkali metal or alkaline earth metal salt.

5. An activating composition for bleaching in accordance with claim 1, wherein the cyanamide derivative is an alkali metal or alkaline earth metal cyanamide, calcium cyanamide, magnesium cyanamide or monosodium cyanamide.

6. An activating composition for bleaching in accordance with claim 1, wherein the activator is calcium cyanamide and said protective mixture is made up of finely divided magnesium silicate powder and, in the form of a magnesium complex, diethylenetriaminepentaacetic acid and diethylenetriaminepentamethylenephosphonic acid.

7. An activating composition for bleaching in accordance with claim 1, wherein the cyanamide derivative is only slightly soluble, and the granulometry thereof is less than 100 microns.

8. An activating composition for bleaching in accordance with claim 1, wherein said protective mixture has a magnesium silicate base and contains, in the form of a magnesium complex, 3 to 30% of an acetic type sequestering agent and 5 to 50% of a phosphonic type sequestering agent, the proportions being indicated by weight in relation to the magnesium silicate.

9. An activating composition for bleaching in accordance with claim 8, wherein the protective mixture has a magnesium silicate base and contains, in magnesium complex form, 5 to 15% of an acetic type sequestering agent and 8 to 25% of a phosphonic type sequestering agent, the proportions being indicated by weight in relation to the magnesium silicate.

10. An activating composition for bleaching in accordance with claim 1, wherein the composition contains 20 to 150% by weight, of activator of the cyanamide type or a derivative thereof in relation to the protective mixture representing 100%.

11. An activating composition for bleaching in accordance with claim 10 wherein the composition contains 30 to 100% by weight of activator of the cyanamide type or a derivative thereof in relation to the protective mixture representing 100%.

12. An activating composition for bleaching in accordance with claim 1, wherein the concentration of said composition in the washing powder bath is between 0.2 and 1 g per liter.

13. An activating composition for bleaching in accordance with claim 12 wherein the concentration of said composition in the washing powder bath is between 0.4 and 0.8 g/liter.

14. A bleaching composition consisting essentially of a water-soluble powdery solid peroxide bleaching agent capable of releasing active oxygen; an activator of the cyanamide type or a derivative thereof; and a ternary protective mixture for the protection of cellulose fibers contacted by an aqueous solution of said composition, comprising a finely divided magnesium silicate powder, a sequestering agent of the organoacetic type and a sequestering agent of the organophosphonic type; and optionally a detergent.

15. A method of washing or bleaching cellulose fiber containing fabric, comprising mixing a composition of claim 14 with water at a temperature greater than 60° C. to form a bath, and treating said fabric in said bath.

16. An activating composition for bleaching in accordance with claim 4, wherein the cyanamide derivative is alkali metal or alkaline earth metal cyanamide, calcium cyanamide, magnesium cyanamide or monosodium cyanamide.

17. An activating composition for bleaching in accordance with claim 2, wherein the cyanamide derivative is only slightly soluble, and the granulometry thereof is less than 100 microns.

18. An activating composition for bleaching in accordance with claim 3, wherein the cyanamide derivative is only slightly soluble, and the granulometry thereof is less than 100 microns.

19. An activating composition for bleaching in accordance with claim 4, wherein the cyanamide derivative is only slightly soluble, and the granulometry thereof is less than 100 microns.

20. An activating composition for bleaching in accordance with claim 10, wherein the cyanamide derivative is only slightly soluble, and the granulometry thereof is less than 100 microns.

* * * * *